US012799710B2

(12) United States Patent
Torii et al.

(10) Patent No.: US 12,799,710 B2
(45) Date of Patent: Nov. 17, 2026

(54) WORKING MACHINE

(71) Applicant: KUBOTA CORPORATION, Osaka (JP)

(72) Inventors: Yoshinori Torii, Osaka (JP); Yusuke Nishira, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 287 days.

(21) Appl. No.: 18/741,336

(22) Filed: Jun. 12, 2024

(65) Prior Publication Data

US 2025/0003184 A1 Jan. 2, 2025

(30) Foreign Application Priority Data

Jun. 30, 2023 (JP) ..... 2023-107905

(51) Int. Cl.
*E02F 9/08* (2006.01)

(52) U.S. Cl.
CPC ..... *E02F 9/0883* (2013.01)

(58) Field of Classification Search
CPC ..... B60K 15/07; B60K 15/067; B60K 15/04; B60K 15/03; B60K 15/03006; B60K 2015/0496; B60K 2015/03453; B60K 2015/0477; E02F 9/0883
See application file for complete search history.

(56) References Cited

U.S. PATENT DOCUMENTS

2013/0341481 A1* 12/2013 Sasaki ..... E02F 9/0883 248/503
2016/0258132 A1* 9/2016 Nakano ..... E02F 9/0891
2016/0288845 A1* 10/2016 Honda ..... B60K 13/04
2018/0245381 A1* 8/2018 Setaki ..... B60K 15/063
(Continued)

FOREIGN PATENT DOCUMENTS

JP 60199724 A * 10/1985 ..... F02M 25/0872
JP H1094315 A * 4/1998
(Continued)

OTHER PUBLICATIONS

Office Action issued in Japan Counterpart Patent Appl. No. 2023-107905, dated Mar. 17, 2026, along with an English translation thereof.

*Primary Examiner* — Drew J Brown
*Assistant Examiner* — Matthew D Lee
(74) *Attorney, Agent, or Firm* — GREENBLUM & BERNSTEIN, P.L.C.

(57) ABSTRACT

A working machine includes a machine body; a tank including a tank body to store a liquid, and a tubular portion protruding from an outer surface of the tank body in a protruding direction inclined from the outer surface; a fixing piece having a through hole through which the tubular portion is inserted, to fix the tank to the machine body; and an elastic member sandwiched between the fixing piece and the tubular portion. The tubular portion has one end connected to the tank body and another end defining a liquid supply opening. The elastic member is fitted on the tubular (Continued)

portion substantially in parallel to the outer surface and non-perpendicularly to the protruding direction. The fixing piece is fitted on the elastic member fitted on the tubular portion, substantially in parallel to the outer surface, and is fixed to the machine body.

12 Claims, 14 Drawing Sheets

(56) References Cited

U.S. PATENT DOCUMENTS

| | | | | |
|---|---|---|---|---|
| 2019/0119883 | A1* | 4/2019 | Ichihara | B62D 33/063 |
| 2020/0190774 | A1 | 6/2020 | Nishigori et al. | |
| 2025/0297453 | A1* | 9/2025 | Takaki | E02F 9/0883 |

FOREIGN PATENT DOCUMENTS

| | | | | | |
|---|---|---|---|---|---|
| JP | 2007217922 | A | | 8/2007 | |
| JP | 2012193575 | A | | 10/2012 | |
| JP | 2017110420 | A | | 6/2017 | |
| JP | 2019147441 | A | * | 9/2019 | B60K 15/0406 |
| JP | 2021-185306 | A | | 12/2021 | |
| JP | 2023050725 | A | | 4/2023 | |

* cited by examiner

WORKING MACHINE

CROSS REFERENCE TO RELATED APPLICATIONS

This application claims the benefit of priority to Japanese Patent Application No. 2023-107905 filed on Jun. 30, 2023. The entire contents of this application are hereby incorporated herein by reference.

BACKGROUND OF THE INVENTION

1. Field of the Invention

The present invention relates to a working machine including a tank that stores a liquid such as fuel.

2. Description of the Related Art

A working machine disclosed in Japanese Unexamined Patent Application Publication No. 2021-185306 is known. The working machine disclosed in Japanese Unexamined Patent Application Publication No. 2021-185306 includes a fuel tank that stores fuel to be supplied to a prime mover. The fuel tank is provided with a tubular portion protruding in a direction inclined obliquely upward from an outer surface of the tank, and an oil supply opening at a distal end of the tubular portion.

SUMMARY OF THE INVENTION

However, in the technique of Japanese Unexamined Patent Application Publication No. 2021-185306, since the tubular portion is provided in an inclined manner, there is a problem that workability is poor when the tubular portion is fixed to a machine body. For example, when a plane perpendicular to the protruding direction of the tubular portion is not parallel to an attachment surface of a member for fixing the tubular portion to the machine body with respect to the tubular portion, it takes time and effort for work of inserting the member into the tubular portion or positioning the member with respect to the tubular portion in a state of being non-perpendicular to the protruding direction.

In view of the above problems, an object of the present invention is to easily fix a tank including a tubular portion protruding from a tank body in an inclined direction, to a machine body.

A working machine according to an aspect of the present invention includes a machine body; a tank including a tank body to store a liquid, and a tubular portion protruding from an outer surface of the tank body in a protruding direction inclined with respect to the outer surface; a fixing piece having a through hole through which the tubular portion is inserted, to fix the tank to the machine body; and an elastic member sandwiched between the fixing piece and the tubular portion. The tubular portion has one end connected to the tank body and another end defining a liquid supply opening. The elastic member is fitted on the tubular portion in a state of being substantially parallel to the outer surface and non-perpendicular to the protruding direction of the tubular portion. The fixing piece is fitted on the elastic member fitted on the tubular portion, substantially in parallel to the outer surface, and is fixed to the machine body.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

DETAILED DESCRIPTION OF THE EXAMPLE EMBODIMENTS

Figure 1:
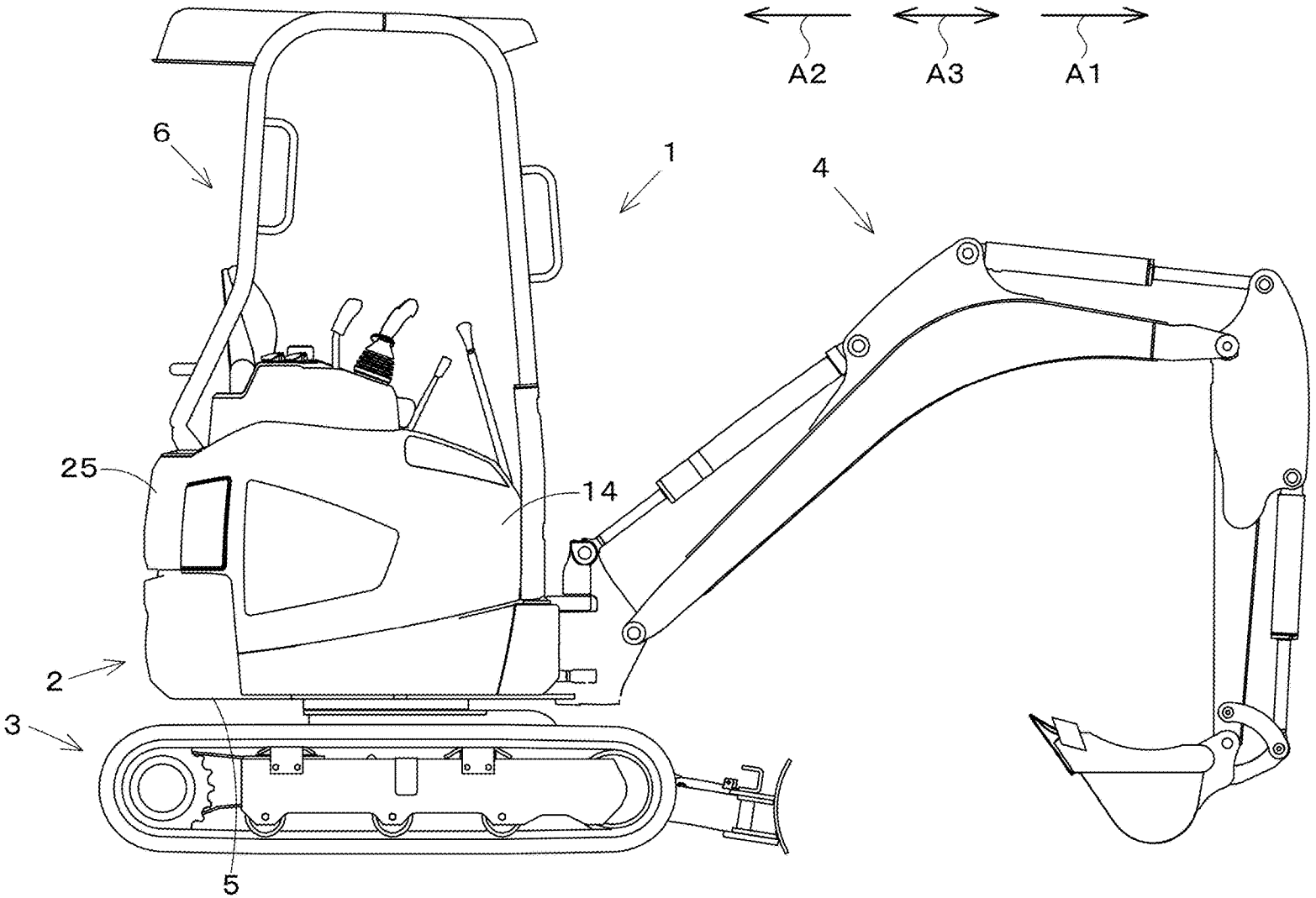
FIG. 1 is an overall side view of a working machine according to an embodiment of the present invention as viewed from the right.

Example embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with reference to the drawings.

Figure 2:
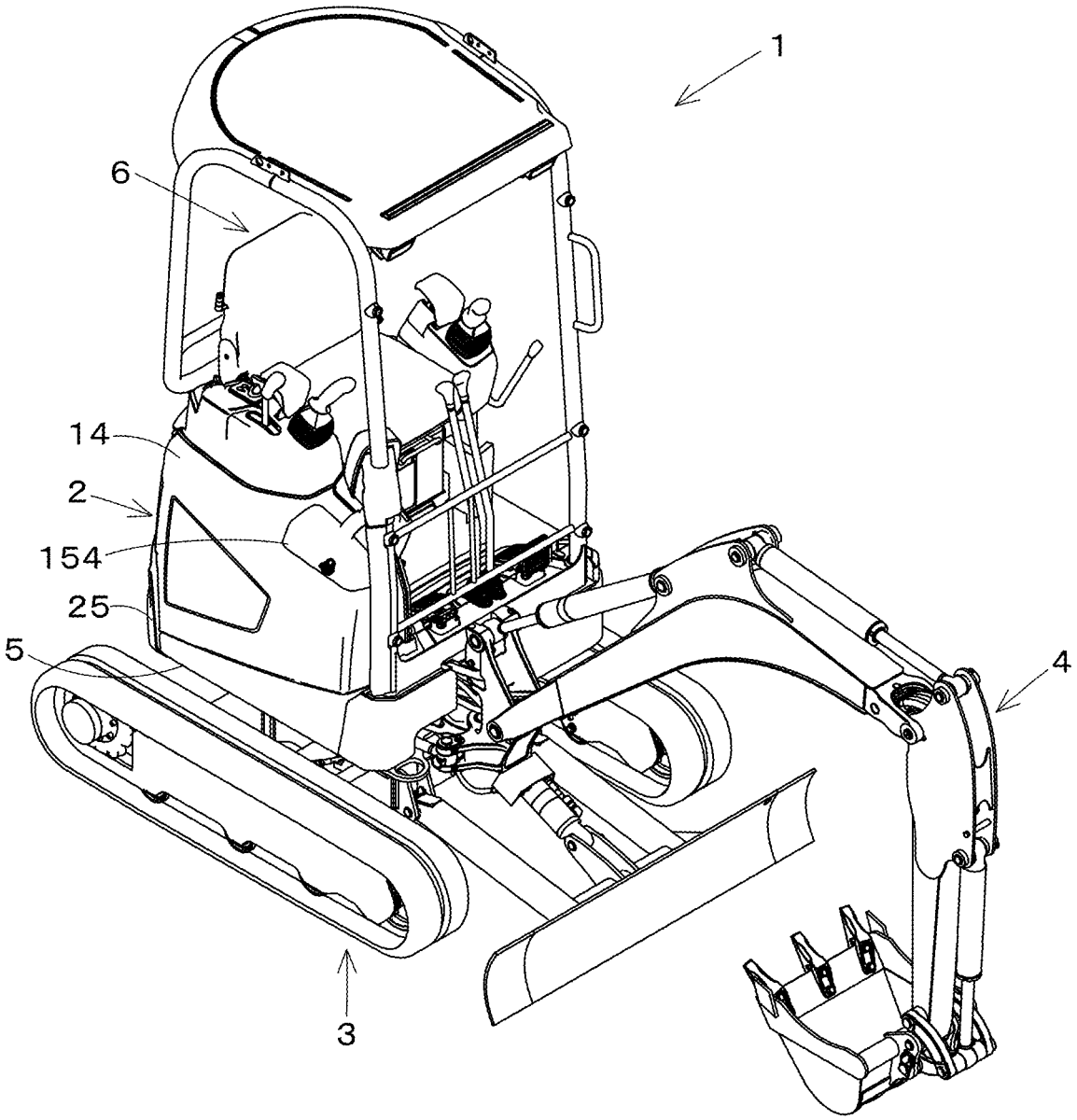
FIG. 2 is an overall perspective view of the working machine according to the embodiment as viewed from the right.

FIG. 1 is a side view illustrating an overall configuration of a working machine 1 according to the present embodiment. FIG. 2 is a perspective view illustrating the overall configuration of the working machine 1 according to the present embodiment. In the present embodiment, an arrow A1 direction in FIG. 1 is referred to as a forward side, an arrow A2 direction in FIG. 1 is referred to as a rearward side, and an arrow A3 direction in FIG. 1 is referred to as a front-rear direction. Also, a near side in FIG. 1 is referred to as a rightward side, and a far side in FIG. 1 is referred to as a leftward side. Further, a horizontal direction that is a direction orthogonal to the front-rear direction A3 is described as a width direction.

As illustrated in FIGS. 1 and 2, the working machine 1 of the present embodiment includes a machine body 2, a traveling device 3 that supports the machine body 2 so as to be capable of traveling, a prime mover 91 (see FIG. 3), and a working device 4. The prime mover 91 drives a hydraulic pump 95 (described later), and the traveling device 3 and the working device 4 are driven with hydraulic pressure supplied from the hydraulic pump 95.

In the present embodiment, the working machine 1 includes, in addition to the prime mover 91, a weight 25 for balancing the weight with the working device 4, a cabin that houses an operator's seat 6, and the like, and the machine body 2 supports mounted objects such as the prime mover 91, the weight 25, and the cabin.

Specifically, as illustrated in FIG. 2, the machine body 2 includes a frame to which the traveling device 3 is coupled, a turning bearing fixed to the frame, and a turning base plate 5 rotatably (turnably) attached to the frame via the turning bearing, and the operator's seat 6 (cabin), the weight 25, and the like are disposed on the turning base plate 5. In the present embodiment, the working machine 1 includes a cover 14 that covers the prime mover 91, the weight 25, and the like. That is, the mounted objects such as the weight 25 are covered with the cover (hereinafter, referred to as an exterior cover) 14.

Figure 3:
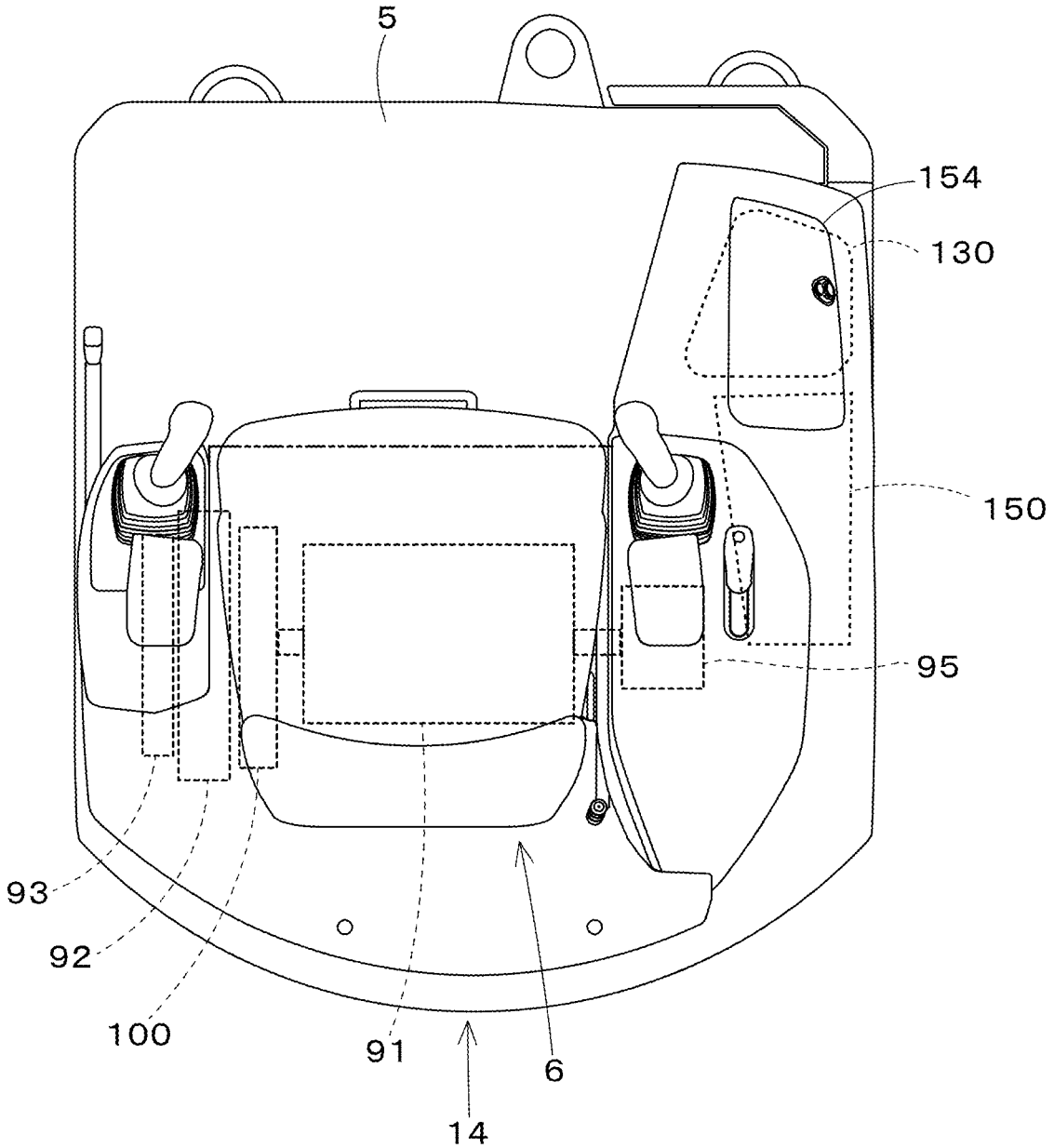
FIG. 3 is a plan view of a machine body of the working machine according to the embodiment.

In the present embodiment, the traveling device 3 is a crawler travel device (endless belt traveling device). The prime mover 91 is an internal combustion engine (engine). Accordingly, as illustrated in FIG. 3, the working machine 1 includes a tank (hereinafter, referred to as a fuel tank) 130 that stores fuel to be supplied to the prime mover 91.

The prime mover 91 is mounted in a center portion in the width direction of a rear portion of the machine body 2. The prime mover 91 is disposed below the operator's seat 6. A radiator 92, an oil cooler 93, a hydraulic pump 95, and a cooling fan 100 are disposed both leftward and rightward of the prime mover 91.

A right portion of the exterior cover 14 extends to protrude forward to the vicinity of a right front end of the machine body 2. The fuel tank 130 and a hydraulic fluid tank 150 are disposed inside the right portion of the exterior cover 14. A door 154 with a locking function that enables access to the fuel tank 130 during refueling or the like is provided in an outer side surface of the right portion of the exterior cover 14.

Figure 4:
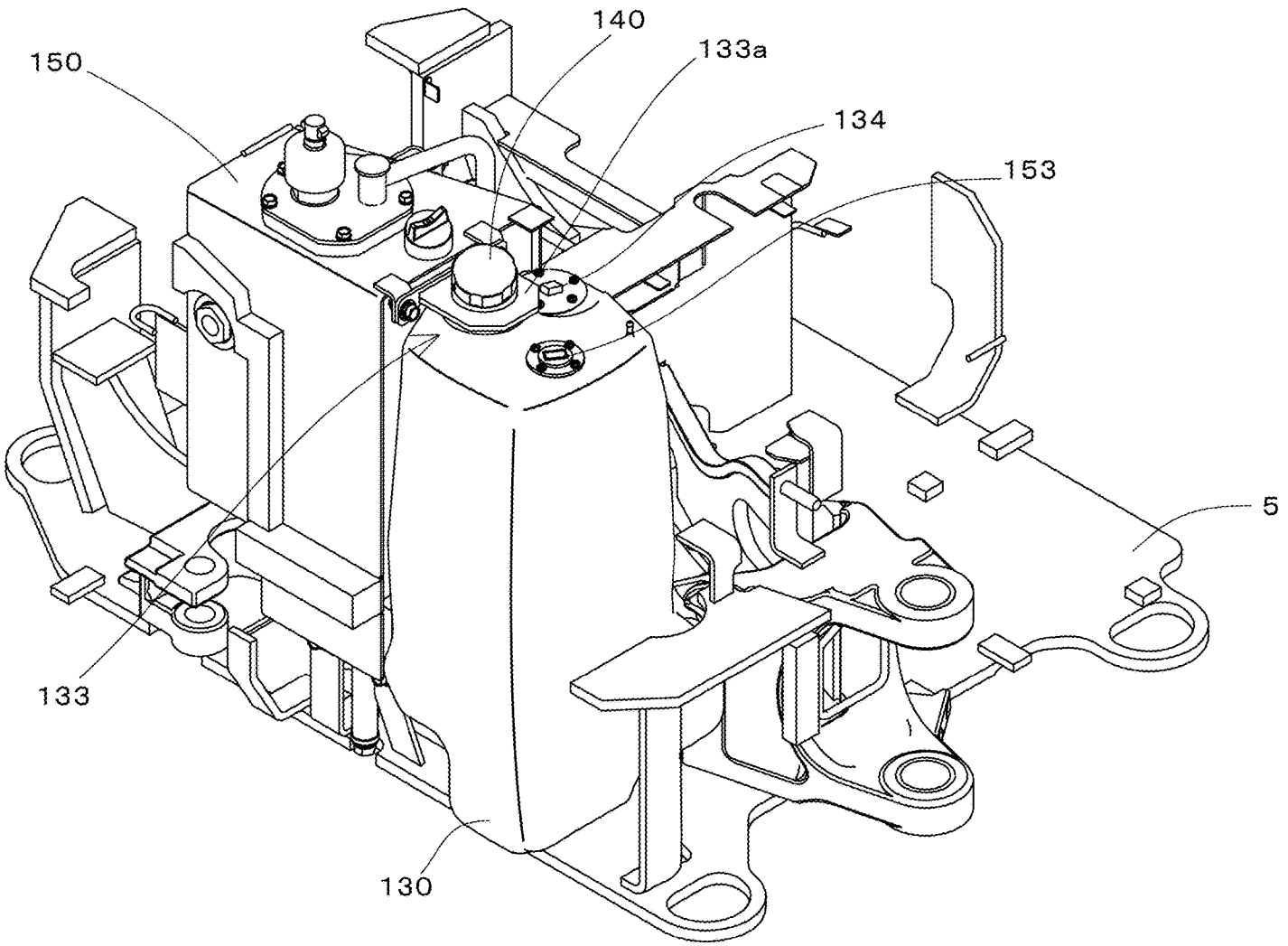
FIG. 4 is a perspective view illustrating an attachment structure of a tank to a turning base plate of the working machine according to the embodiment.

The fuel tank 130 stores fuel such as light oil or gasoline. As illustrated in FIG. 4, the fuel tank 130 is disposed on the turning base plate 5 that is a portion of the machine body 2. Although details will be described later, in the present embodiment, the fuel tank 130 is fixed in a state of being supported by the turning base plate 5.

Figure 5:
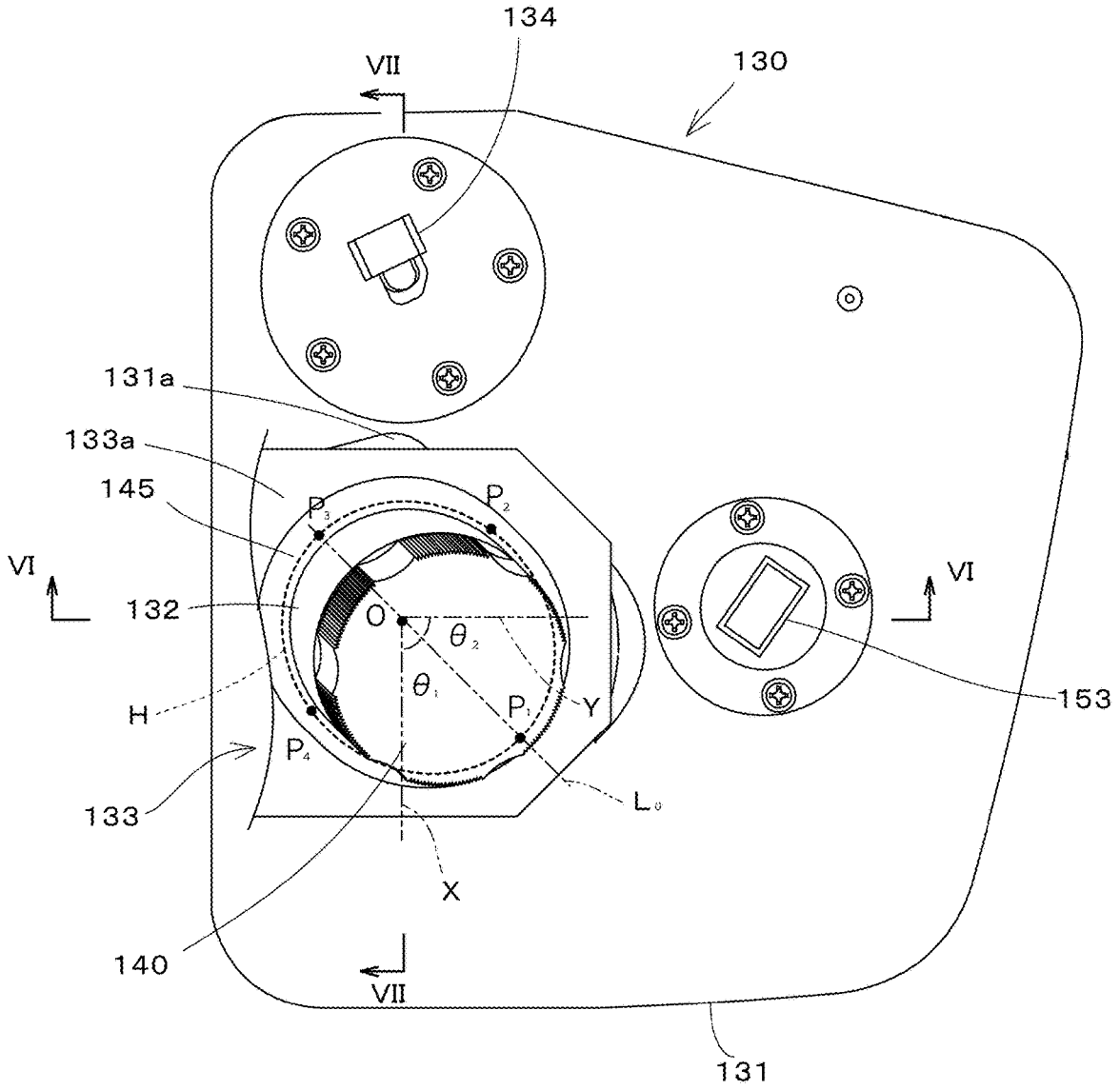
FIG. 5 is a plan view of the tank of the working machine according to the embodiment as viewed from above.

As illustrated in FIG. 5, the fuel tank 130 includes a tank body 131 that stores a liquid, and a tubular portion 132 protruding in a protruding direction inclined with respect to an outer surface 131*a* of the tank body 131. On the premise that the fuel tank 130 includes the tank body 131 and the tubular portion 132, the working machine 1 includes, as means for fixing the fuel tank 130, a fixing piece 133 that has a through hole 149 through which the tubular portion 132 is inserted and fixes the fuel tank 130 to the machine body 2, and an elastic member 145 sandwiched between the fixing piece 133 and the tubular portion 132.

Figure 6:
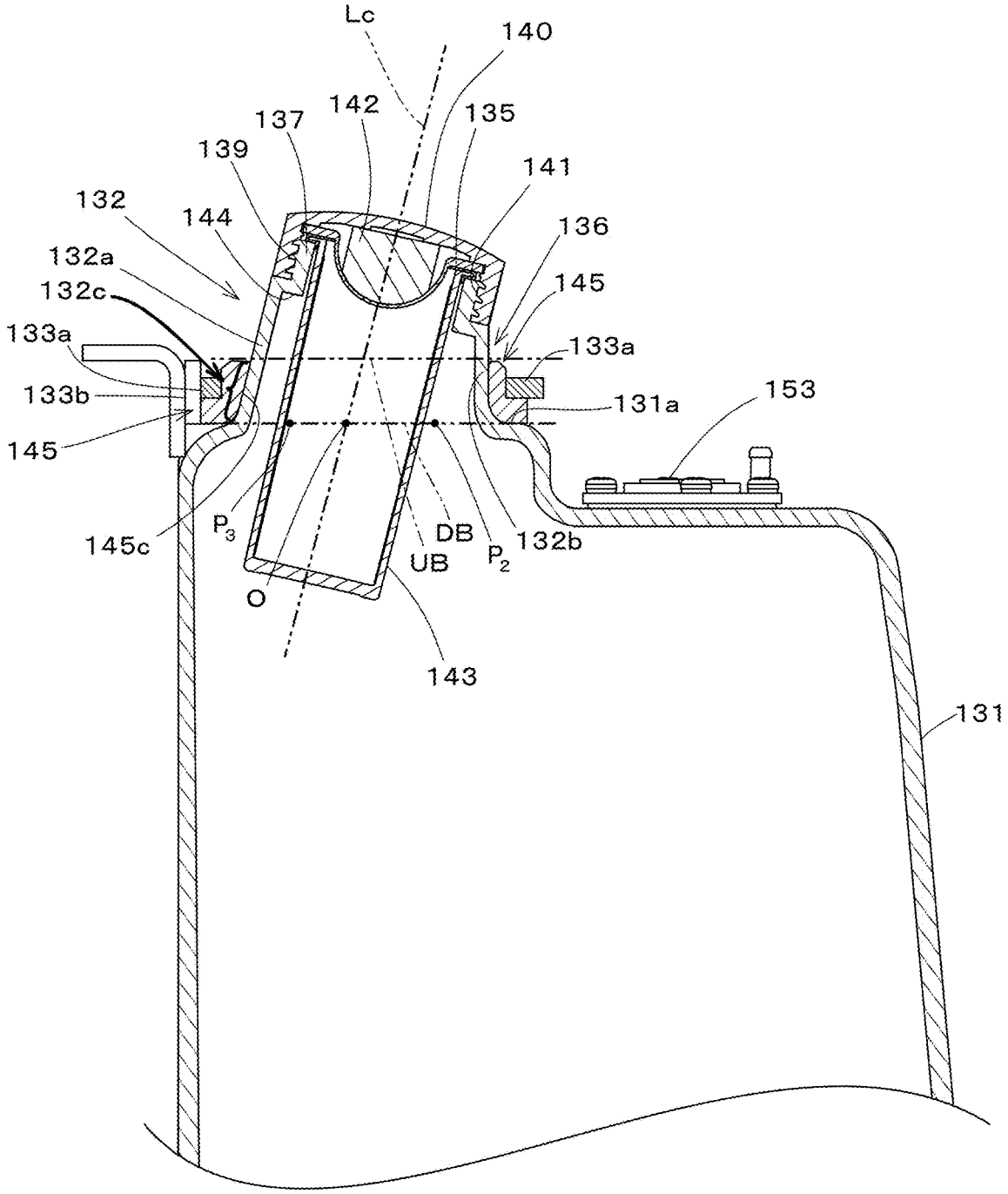
FIG. 6 is a partly sectional view taken along line VI-VI in FIG. 5.

First, the fuel tank 130 will be described in detail. As illustrated in FIG. 4, the fuel tank 130 is disposed with the outer surface 131*a* of the tank body 131 facing upward. The tank body 131 is formed to have one direction in a longitudinal direction. In the present embodiment, the tank body 131 is disposed to have the one direction in a vertical direction. That is, the tank body 131 is a vertically long container that stores a liquid, and is formed of synthetic resin or the like. The tank body 131 is hollow and stores liquid fuel. The tank body 131 is disposed in an upright state on the turning base plate 5. As illustrated in FIG. 6, a planar portion 131*a* is included in one surface in one direction of outer surfaces of the tank body 131. That is, the planar portion 131*a* is included in an upper surface that is the one surface in the up-down direction of the outer surfaces of the tank body 131.

The tubular portion 132 has one end connected to the tank body 131 and another end defining a liquid supply opening 135. Thus, the tubular portion 132 protrudes from the outer surface 131*a* of the tank body 131. In the present embodiment, the tubular portion 132 protrudes in the protruding direction inclined with respect to the planar portion 131*a* of the upper surface that is the outer surface of the tank body 131. In this case, in the present embodiment, the protruding direction is an outward side of the machine body 2 with respect to a vertically upward side.

That is, the upper surface of the tank body 131 is "an outer surface 131*a* from which the tubular portion 132 protrudes (an outer surface 131*a* to which a proximal end of the tubular portion 132 is connected)". In the present embodiment, the upper surface (the outer surface facing upward) of the tank body 131 has a high portion and a low portion, and the high portion is the planar portion 131*a*.

As illustrated in FIGS. 4 to 6, the tubular portion 132 protrudes from the planar portion 131*a* at the high portion of the upper surface of the tank body 131 having the high portion and the low portion, and liquid level sensors 153 and 134 are provided at the low portion around the planar portion 131*a*. The tubular portion 132 is disposed at a position shifted from a center portion of the upper surface of the tank body 131. In the present embodiment, the tubular portion 132 (planar portion 131*a*) is positioned at a substantially center portion near one side surface of a peripheral wall of the tank body 131. In the present embodiment, the one side surface of the peripheral wall of the tank body 131 is located in a backward direction of the traveling device 3, and accordingly, the tubular portion 132 (planar portion 131*a*) is disposed at a center portion in the left-right direction of a rear portion of the upper surface. Accordingly, the liquid level sensor 153 is disposed at a front portion of the upper surface of the tank body 131 (forward of the tubular portion 132), and the liquid level sensor 134 is disposed at a lateral portion of the upper surface of the tank body 131 (beside the tubular portion 132: leftward in the present embodiment). In the present embodiment, the liquid level sensor 153 detects the liquid level of the liquid stored in the tank body 131 using a float, and displays the amount of liquid in the tank using a needle that moves in association with the float. The liquid level sensor 134 detects the liquid level in the tank and sends a signal corresponding to the detection result to a controller (not illustrated). Thus, the amount of liquid corresponding to the detection result of the liquid level sensor 134 is displayed on a meter panel (not illustrated).

The tubular portion 132 will be described in more detail. As illustrated in FIGS. 5 and 6, the tubular portion 132 has the one end connected to the tank body 131, a middle portion extending obliquely upward from the one end, and the other end defining the liquid supply opening (oil supply opening) 135 opened obliquely upward. An opening center line Lc, which is a straight line passing through the center of the liquid supply opening 135 and orthogonal to an opening end surface (another end surface, an imaginary plane including an end portion near the other end of the tubular portion 132) of the liquid supply opening 135, is inclined toward a machine-body outward side (obliquely forward and rightward in the present embodiment) with respect to a direction orthogonal to the outer surface 131*a* of the tank body 131 (the vertical direction in the present embodiment). That is, the opening center line Lc extends obliquely upward in an inclination direction (an extending direction of the middle portion) of the tubular portion 132.

In the present embodiment, the elastic member 145 is fitted on an outer peripheral surface of the tubular portion 132. The elastic member 145 is in contact with (is in close contact with) a predetermined area (contact area 132*c*) of the outer peripheral surface of the tubular portion 132. As illustrated in FIG. 6, the contact area 132*c* is an area between a lower limit position (a position of a lower end of the elastic member 145 that is fitted) DB near the one end of the tubular portion 132 and an upper limit position (a position of an upper end of the elastic member 145 that is fitted) UB near the other end of the tubular portion 132.

The contact area 132*c* of the tubular portion 132 has the lower limit position DB at the one end of the tubular portion 132 and the upper limit position UB at a position separated from the lower limit position DB by a width of the elastic member 145. The tubular portion 132 is disposed such that a portion of the tubular portion 132 closer to the other end than the contact area 132*c* is accommodated within a range of a closed curve formed by the contact area 132*c* in a projection when viewed in the direction orthogonal to the outer surface 131*a*. In this case, the "closed curve formed by the contact area 132*c*" means a contour of the contact area 132*c* when viewed in the direction orthogonal to the outer surface (planar portion) 131*a*. In the present embodiment, the liquid supply opening 135 is disposed so as to be accommodated within a range of an annular contour (closed curve) of an outer periphery of the tubular portion 132 at the upper limit position UB of the contact area 132*c* in a projection when viewed in the direction orthogonal to the outer surface (planar portion) 131*a*.

The tubular portion 132 has an angle formed by the outer peripheral surface of the tubular portion 132 and the outer surface 131*a* in a section perpendicular to the outer surface 131*a* and passing through the center of the tubular portion 132 at the one end being 90° or more at any position in the circumferential direction of the tubular portion 132. The outer peripheral surface of the tubular portion 132 has an inclination at an angle of 90° or more with respect to the outer surface 131*a* at any position in the circumferential direction.

As illustrated in FIG. 6, the tubular portion 132 is enlarged from a portion near the other end (upper end) toward the one end (lower end). That is, the tubular portion 132 includes an enlarged portion 136 whose sectional shape is enlarged from the portion near the other end toward the one end. In the present embodiment, the tubular portion 132 includes the enlarged portion 136 protruding from the tank body 131 and enlarged toward the tank body 131, and a cylindrical portion 137 being continuous with a distal end of the enlarged portion 136 and defining the liquid supply opening 135.

Before describing the angle formed between the outer peripheral surface of the tubular portion 132 (enlarged portion 136) and the outer surface 131*a*, points O and $P_1$ to $P_4$ used for the description will be described with reference to FIGS. 5 and 6. As illustrated in FIG. 6, the point O is an intersection point of an imaginary plane passing through the lower limit position DB of the contact area 132*c* and the opening center line Lc. The points $P_1$ to $P_4$ are positions (points) on the imaginary plane passing through the lower limit position DB of the contact area 132*c*, and are located around the point O. That is, the points $P_1$ to $P_4$ are located on the line of a contour H of the lower limit position DB indicated by a broken line in FIG. 5. The point $P_1$ is located forward and outward (in the protruding direction of the tubular portion 132) when viewed from the point O, the point $P_3$ is located rearward and inward (opposite to the protruding direction of the tubular portion 132) when viewed from the point O, and the points $P_2$ and $P_4$ are located in a direction orthogonal to an imaginary straight line connecting the points $P_1$ and $P_3$ when viewed from the point O. A projected line $L_0$ indicated by a two-dot chain line in FIG. 5 is a straight line indicating the opening center line Lc projected from above, and extends through the point O, the point $P_1$, and the point $P_3$. The projected line $L_0$ is inclined at an inclination angle $\theta_1$ with respect to a rightward direction X and at an inclination angle $\theta_2$ with respect to a forward direction Y. In the present embodiment, the inclination angle $\theta_1$ is 45°, and the inclination angle $\theta_2$ is 45°.

The enlarged portion 136 (tubular portion 132) has a first portion 132*a* and a second portion 132*b* in the circumferential direction, the second portion 132*b* connecting both ends in the circumferential direction of the first portion 132*a*.

The first portion 132*a* is formed in the circumferential direction at a rear inner portion of a sectional shape of the tubular portion 132. As illustrated in FIG. 5, the first portion 132*a* of the present embodiment is formed in a half circumference from the point $P_4$ to the point $P_2$ through the point $P_3$ of the tubular portion 132. The first portion 132*a* is formed in a shape (substantially truncated semi-conical shape) that is enlarged in a direction away from the center (a position indicated by the point O) of the sectional shape of the tubular portion 132 toward the outside as the first portion 132*a* approaches the tank body 131.

The second portion 132*b* is formed in the circumferential direction at a front outer portion of the sectional shape of the tubular portion 132. The second portion 132*b* of the present embodiment is formed in a half circumference from the point $P_2$ to the point $P_4$ through the point $P_1$ of the tubular portion 132. The second portion 132*b* is formed to be a cylindrical surface around an axis extending from the point O of the outer surface 131*a* of the tank body 131 in a direction perpendicular to the outer surface 131*a*.

As illustrated in FIG. 6, an outer peripheral surface of the first portion 132*a* has an angle exceeding 90° with respect to the planar portion 131*a* of the tank body 131 at any position in the circumferential direction, and an outer peripheral surface of the second portion 132*b* has an angle of 90° with respect to the planar portion 131*a* of the tank body 131 at any position in the circumferential direction. That is, in the tubular portion 132 of the present embodiment, the first portion 132*a* is formed in a substantially truncated semi-conical shape, and the second portion 132*b* is formed in a semi-cylindrical shape. Thus, the outer peripheral surface of the first portion 132*a* is a semi-conical surface, and the outer peripheral surface of the second portion 132*b* is a semi-conical surface.

The cylindrical portion 137 is a portion in which the outer diameter of the tubular portion 132 is the same from another end (upper end) toward one end (lower end). The cylindrical portion 137 is provided further upward of the upper end (distal end) of the enlarged portion 136, that is, continuously in an upper portion of the tubular portion 132. An opening is formed at the upper end of the cylindrical portion 137, and the opening defines the liquid supply opening 135 for supplying the liquid into the tank body 131. Thus, the inner diameter of the cylindrical portion 137 is equal to the opening diameter of the liquid supply opening 135.

An external thread portion 139 is formed on an outer peripheral surface of the cylindrical portion 137. The external thread portion 139 is screwed to an internal screw portion 141 of a cap 140. That is, the cylindrical portion 137 is configured to be able to be screwed to the cap 140.

The outer diameter of the cylindrical portion 137 is smaller than the outer diameter of the distal end (a distal end portion with a reduced diameter) of the enlarged portion 136. The outer diameter of the cylindrical portion 137 is smaller than the outer diameter of the distal end of the enlarged portion 136.

More specifically, since the second portion 132*b* of the enlarged portion 136 is at 90° with respect to the planar portion 131*a* of the tank body 131, when the cylindrical portion 137 is connected to the enlarged portion 136 so that the liquid supply opening 135 faces obliquely upward, the liquid supply opening 135 is located outside the second portion 132*b*.

In the present embodiment, the outer diameter of the cylindrical portion 137 is set to be smaller than the outer diameter of the distal end of the enlarged portion 136 such that the liquid supply opening 135 is accommodated within the range of the closed curve formed by the contact area 132*c* of the tubular portion 132 in the projection when viewed in the direction orthogonal to the outer surface (planar portion) 131*a*. Note that the cap 140 does not have to be accommodated within the range of the closed curve in the projection when viewed in the direction orthogonal to the outer surface (planar portion) 131*a*.

Accordingly, a step portion 144 that increases in diameter from the cylindrical portion 137 to the enlarged portion 136 is formed between the cylindrical portion 137 and the enlarged portion 136.

Figure 8:
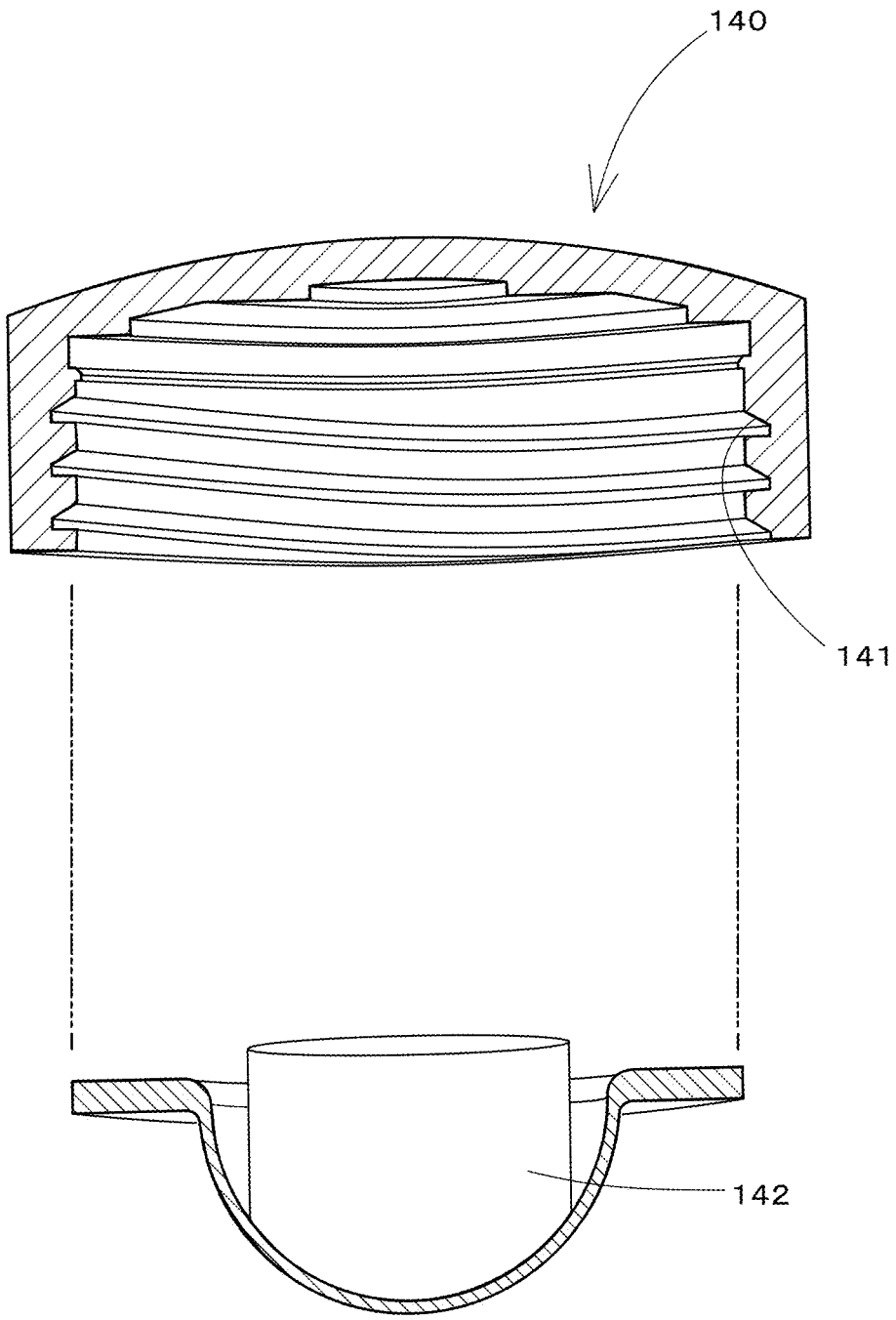
FIG. 8 is a vertical sectional view of a cap of the working machine according to the embodiment.

As illustrated in FIG. 8, the cap 140 is formed in a covered cylindrical shape for sealing the liquid supply opening 135. The internal screw portion 141 that is screwed to the external thread portion 139 formed on the outer peripheral surface of the cylindrical portion 137 is formed in an inner periphery of the cap 140 of the present embodiment. Thus, the cap 140 is configured to be able to be screwed to the cylindrical portion 137 of the tubular portion 132.

An enclosing body 142 raised in a dome shape is formed on an inner peripheral portion (a back surface of a lid) of the cap 140. The enclosing body 142 is formed of an elastic material such as rubber, and is inserted into the cylindrical portion 137 to seal the inside of the cylindrical portion 137.

Figure 7:
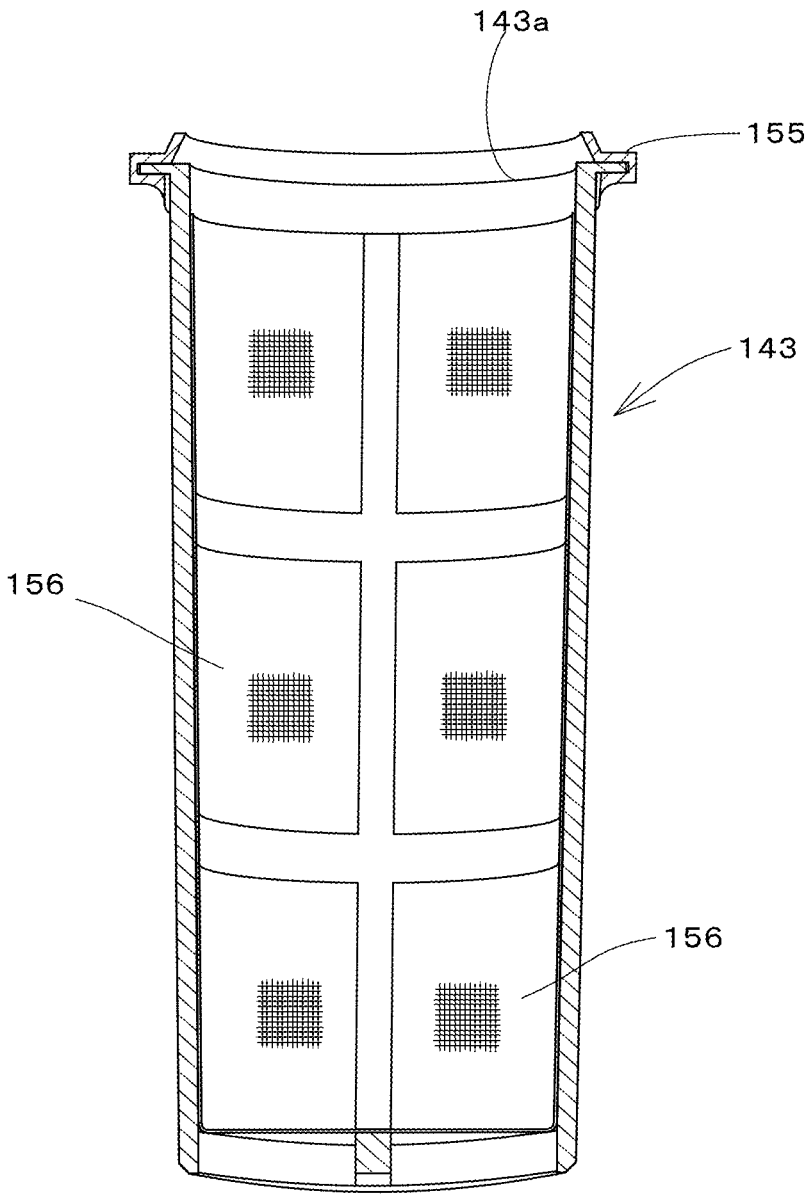
FIG. 7 is a vertical sectional view of a strainer of the working machine according to the embodiment.

As illustrated in FIG. 6, the working machine 1 includes a tubular strainer 143 that is inserted into the tubular portion 132. The strainer 143 is inserted concentrically or substantially concentrically with the opening center line Lc of the liquid supply opening 135. The strainer 143 removes impurities contained in the fuel that is supplied to the fuel tank. As illustrated in FIGS. 6 and 7, the strainer 143 is formed in a tubular shape having a size that can be inserted into the tubular portion 132. That is, the outer diameter of the strainer 143 is slightly smaller than the opening diameter of the liquid supply opening 135, and the strainer 143 can be inserted into the tubular portion 132. One end portion of the strainer 143 is sandwiched between the cap 140 and the cylindrical portion 137, and in this state, the strainer 143 is configured to be concentric or substantially concentric with the opening center line Lc of the liquid supply opening 135. As illustrated in FIG. 7, an opening 143*a* is formed in an upper portion of the strainer 143. A strainer gasket 155 for closely attaching the strainer 143 to the liquid supply opening 135 is provided at the opening 143*a*. A mesh 156 for filtering impurities in the fuel is provided on an outer peripheral portion of the strainer 143.

Figure 9:
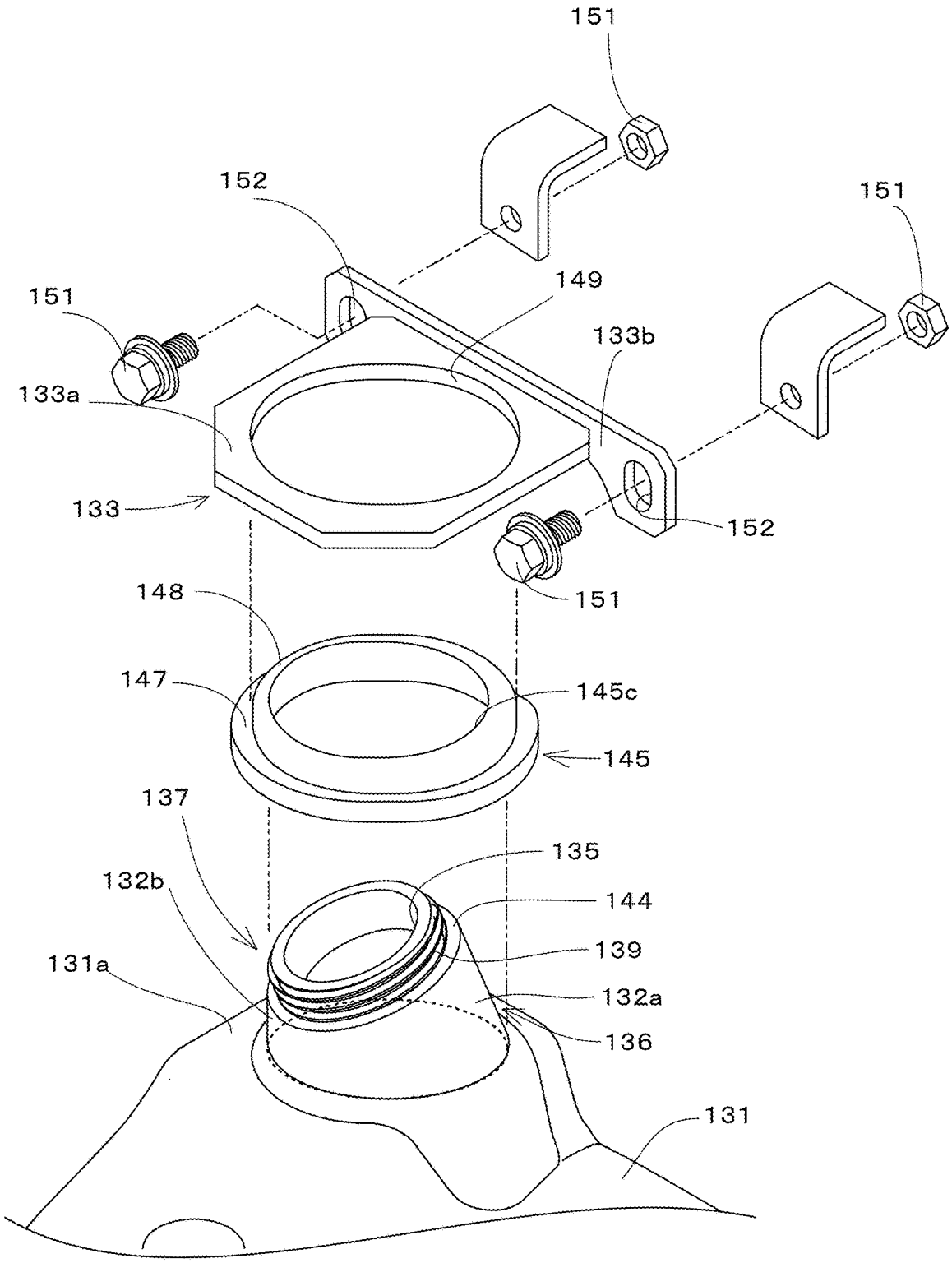
FIG. 9 is an exploded perspective view around a tubular portion of the working machine according to the embodiment.
Figure 10:
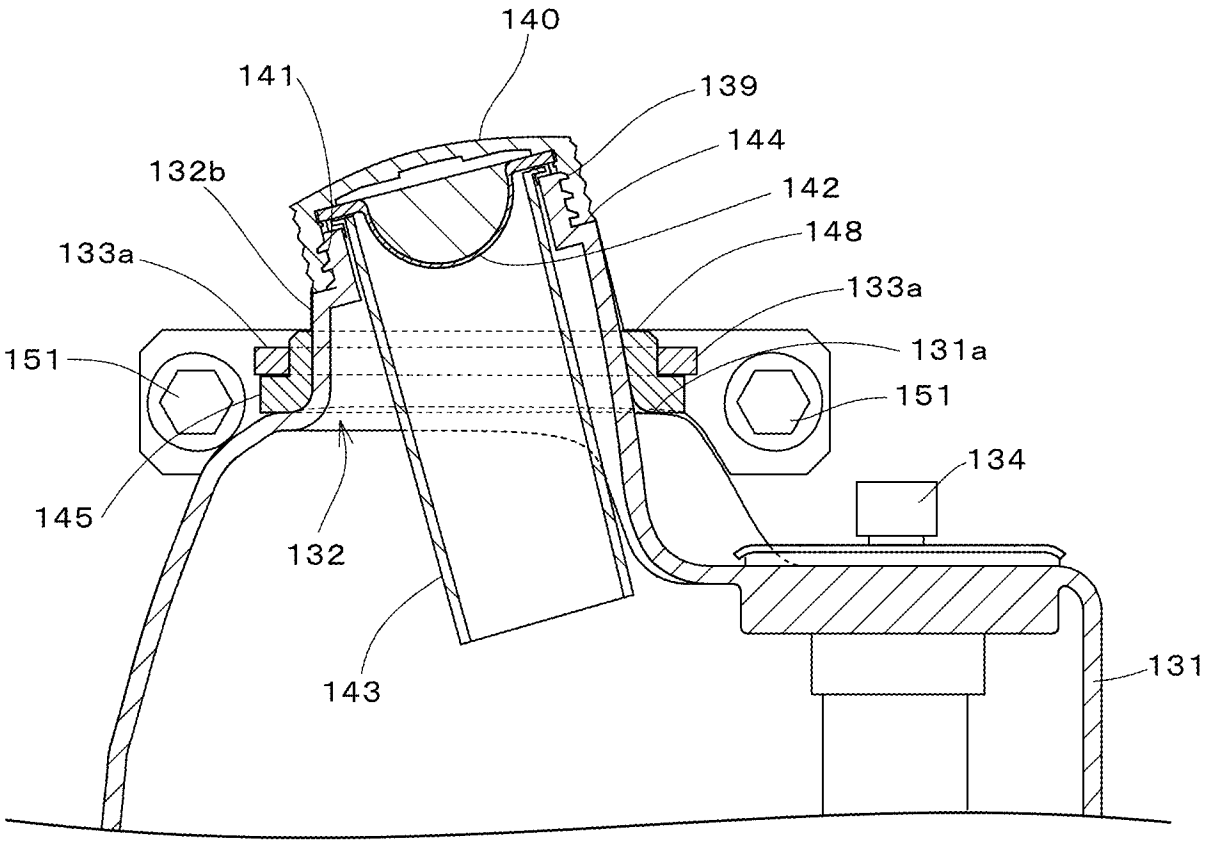
FIG. 10 is a partly sectional view taken along line VII-VII in FIG. 5.

The fuel tank 130 is configured as described above and is fixed to the machine body 2. As described above, the working machine 1 includes the fixing piece 133 and the elastic member 145 as means for fixing the fuel tank 130 to the machine body 2, as illustrated in FIGS. 9 and 10.

The fixing piece 133 is fitted on the elastic member 145 fitted on the tubular portion 132, substantially in parallel to the outer surface 131*a* of the tank body 131, and is fixed to the machine body 2. The fixing piece 133 is fixed to the machine body 2 to fix the tank 130 to the machine body 2. Describing more specifically, the fixing piece 133 has a first piece 133*a* and a second piece 133*b* connected to the first piece 133*a*.

The first piece 133*a* is formed in a plate shape and is configured to be able to be superimposed on the outer surface (planar portion) 131*a* of the tank body 131.

A through hole 149 into which the tubular portion 132 can be inserted is formed at the center of the first piece 133*a*. In the present embodiment, the through hole 149 is formed so that the tubular portion 132 (cylindrical portion 137) of the fuel tank 130 can be loosely fitted therein. That is, the opening diameter of the through hole 149 is set so that a gap is formed between the through hole 149 and the periphery of the inserted tubular portion 132 (cylindrical portion 137).

The second piece 133*b* is connected to one end of the first piece 133*a* and extends in a direction orthogonal to the first piece 133*a*. Fixing holes 152 to fix fixing tools 151 are formed in both end portions of the second piece 133*b*. The second piece 133*b* is directly or indirectly fixed to the machine body 2 via the fixing tools (screw members) 151 inserted into the fixing holes 152 of the second piece 133*b*. In the present embodiment, the fixing piece 133 is fixed at a position at which the first piece 133*a* overlaps the upper surface (planar portion) 131*a* of the fuel tank 130 (tank body 131) disposed on the machine body 2 (turning base plate 5). In the present embodiment, the fixing piece 133 is fixed to an upper surface of the hydraulic fluid tank 150 fixed to the machine body 2, and is indirectly fixed to the machine body 2.

The elastic member 145 is molded from an elastic material such as rubber, and reduces an impact acting on the fuel tank 130 by the fuel tank 130 being fixed to the machine body 2 (working machine 1).

The elastic member 145 is fitted on the tubular portion 132 in a state of being substantially parallel to the outer surface 131*a* of the tank body 131 and non-perpendicular to the protruding direction of the tubular portion 132. That is, the elastic member 145 is formed in an annular shape and is configured to be able to be fitted on the tubular portion 132 of the fuel tank 130.

An inner peripheral surface of the elastic member 145 has a shape that is substantially parallel to the outer surface 131*a* of the tank body 131 on the outer peripheral surface of the tubular portion 132 and that is in close contact with the annular contact area 132*c* non-perpendicular to the protruding direction of the tubular portion 132. That is, the inner peripheral surface of the elastic member 145 is formed in conformity with the outer peripheral surface of the tubular portion 132 and can be in close contact with the outer peripheral surface of the tubular portion 132. In the present embodiment, the elastic member 145 is fitted on the enlarged portion 136 of the tubular portion 132. Accordingly, the elastic member 145 has a through hole into which the enlarged portion 136 is fitted. The inner peripheral shape of the through hole is formed in conformity with the outer peripheral shape of the enlarged portion 136 of the tubular portion 132. Thus, in the elastic member 145, an inner peripheral surface 145*c* defining the through hole can be in close contact with the outer surface of the enlarged portion 136 of the tubular portion 132 over the entire circumference.

The elastic member 145 has a flange portion 147 that is sandwiched between the outer surface (planar portion 131*a*) of the tank body 131 and the fixing piece 133 (first piece 133*a*). Additionally, the elastic member 145 has an annular protruding portion 148 extending from the flange portion 147. The annular protruding portion 148 is sandwiched between the tubular portion 132 (enlarged portion 136) and an inner peripheral surface of the through hole 149 of the fixing piece 133 in the through hole 149 of the fixing piece 133.

The flange portion 147 and the annular protruding portion 148 are integrally molded. The through hole of the elastic member 145 includes inner holes of the flange portion 147 and the annular protruding portion 148. That is, the inner holes of the flange portion 147 and the annular protruding portion 148 continuously form the through hole of the elastic member 145. Accordingly, the inner peripheral surface that is in contact with the contact area included in the outer peripheral surface of the tubular portion 132 is formed by an inner peripheral surface of the flange portion 147 and an inner peripheral surface of the annular protruding portion 148 being continuous. The thickness of the flange portion 147 is set so that the flange portion 147 is sandwiched in a compressed state between the first piece 133*a* of the fixing piece 133 fixed to the machine body 2 and the planar portion 131*a* of the fuel tank 130 supported by the machine body 2. In contrast, the annular protruding portion 148 is disposed in a gap between the inner peripheral surface of the through hole 149 of the fixing piece 133 and the tubular portion 132 (enlarged portion 136). The thickness of the annular protruding portion 148 is set so that the annular protruding portion 148 is in a compressed state between the inner peripheral surface of the through hole 149 of the fixing piece 133 and the tubular portion 132 (enlarged portion 136). Thus, the elastic member 145 (annular protruding portion 148) fills the gap between the inner peripheral surface of the through hole 149 of the fixing piece 133 and the tubular portion 132 (enlarged portion 136), and absorbs a lateral impact acting on the fuel tank 130 while restricting lateral shaking of the fuel tank 130 (tubular portion 132).

A portion of the annular protruding portion 148 protrudes from the fixing piece 133 toward the other end of the tubular portion 132 when the fixing piece 133 is fitted on the annular protruding portion 148. That is, the annular protruding portion 148 is also formed so as to protrude outward from the first piece 133*a* of the fixing piece 133. Specifically, an upper end of the annular protruding portion 148 protrudes further upward from the fixing piece 133. When the upper end of the annular protruding portion 148 protrudes upward from the fixing piece 133 in this manner, the upper end of the annular protruding portion 148 protruding upward from the fixing piece 133 is expanded by an elastic force of the elastic material. The expanded annular protruding portion 148 prevents or reduces coming off of the elastic member 145 downward from the through hole 149 of the fixing piece 133. Thus, with the elastic member 145 of the present embodiment, the elastic member 145 sandwiched between the outer surface 131*a* of the tank body 131 and the fixing piece 133 is less likely to come off.

Next, a procedure for assembling the elastic member 145 and the fixing piece 133 to the tubular portion 132 will be described with reference to FIGS. 11 to 14.

Figure 11:
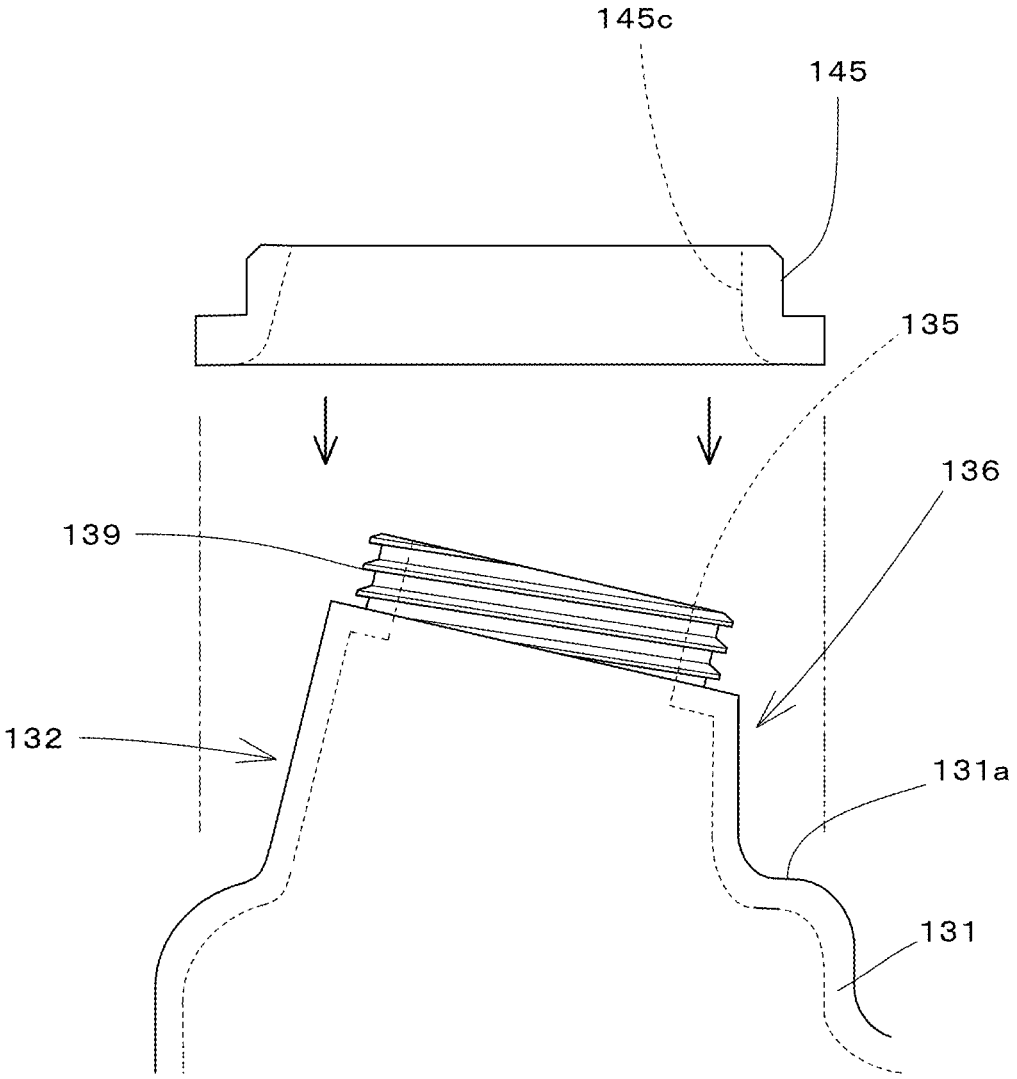
FIG. 11 is an explanatory view of a procedure for attaching an elastic member and a fixing piece to the tubular portion.

As illustrated in FIG. 11, the elastic member 145 is brought close to the tubular portion 132 from the annular protruding portion 148 side in the direction orthogonal to the outer surface (planar portion) 131*a* of the tank body 131. The opening diameter of the annular protruding portion 148 of the elastic member 145 is equal to or slightly smaller than the outer diameter of the lower end (one end) of the tubular portion 132 (the outer diameter of the lower end of the enlarged portion 136). Thus, the other end of the tubular portion 132 having a smaller diameter than the diameter of the one end can be easily inserted into the opening of the annular protruding portion 148 having a larger opening diameter than the opening diameter of the other end. Also, since the liquid supply opening 135 is disposed so as to be accommodated within the range of the closed curve formed by the contact area 132*c* of the tubular portion 132 in the projection when viewed in the direction orthogonal to the planar portion 131*a* of the tank body 131, the elastic member 145 can be easily guided toward the one end of the tubular portion 132 by the elastic member 145 being moved straight in the direction orthogonal to the planar portion 131*a*. Since the inner peripheral surface 145*c* of the elastic member 145 is formed in conformity with the outer peripheral surface (the outer peripheral surface near the lower end) of the tubular portion 132, when the elastic member 145 is brought close to the outer peripheral surface 131*a* of the tank body 131 until the elastic member 145 comes into contact with the outer surface 131*a*, the inner peripheral surface 145*c* of the elastic member 145 comes into close contact with the outer peripheral surface of the tubular portion 132.

Figure 12:
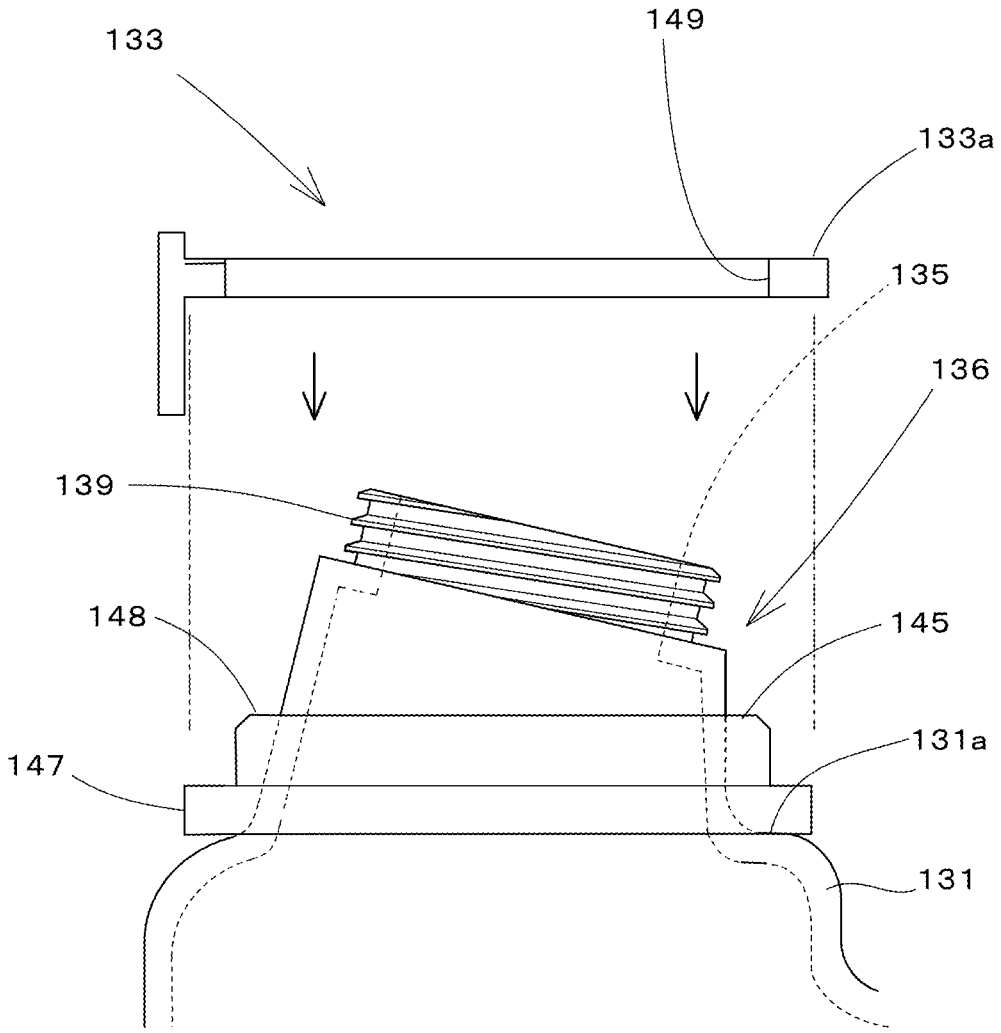
FIG. 12 is an explanatory view of the procedure for attaching the elastic member and the fixing piece to the tubular portion.

Then, as illustrated in FIG. 12, the fixing piece 133 is brought close to the elastic member 145 in close contact with the outer peripheral surface of the tubular portion 132 (enlarged portion 136) in the direction orthogonal to the outer surface (planar portion) 131*a* of the tank body 131 (from above), and the tubular portion 132 and the annular protruding portion 148 are inserted (press-fitted) into the through hole 149 of the first piece 133*a* of the fixing piece 133. Along with this, the elastic member 145 (flange portion 147) is sandwiched between the first piece 133*a* of the fixing piece 133 and the outer peripheral surface of the tubular portion 132.

Figure 13:
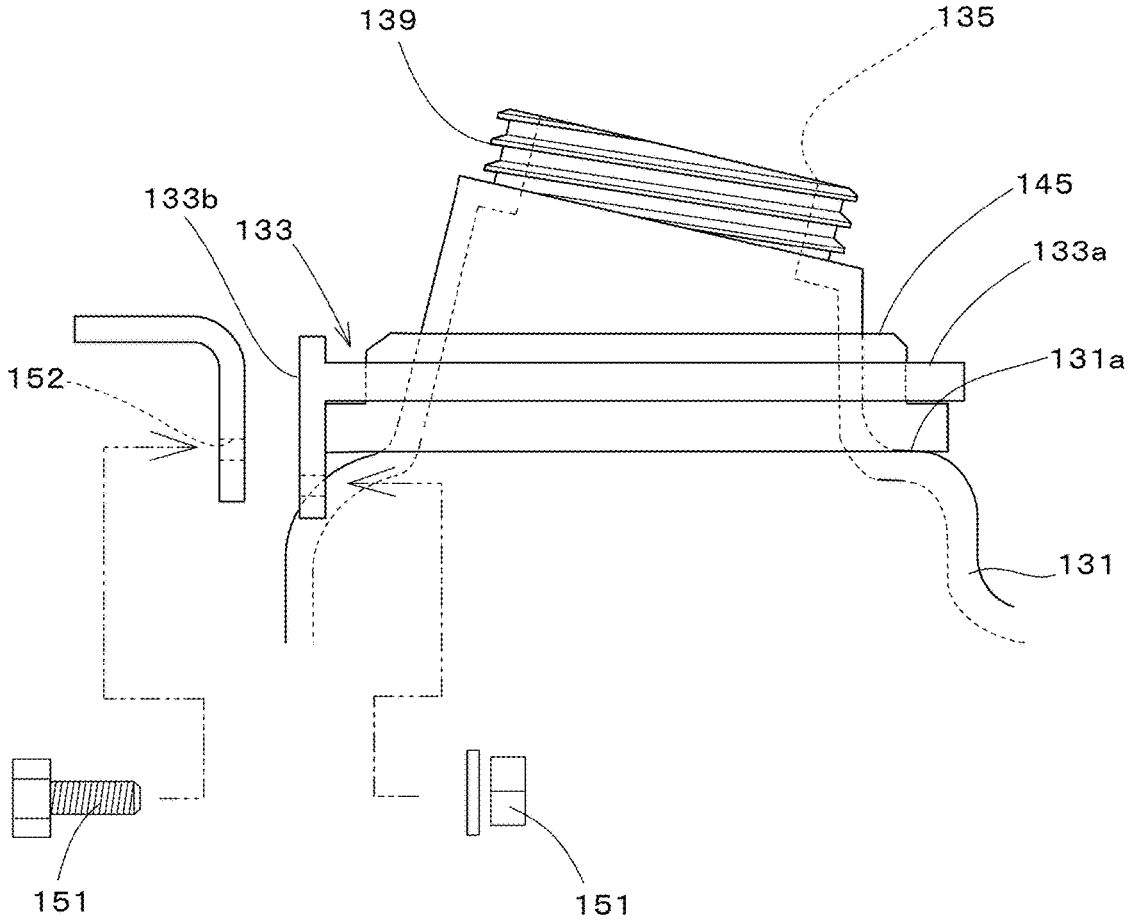
FIG. 13 is an explanatory view of the procedure for attaching the elastic member and the fixing piece to the tubular portion.
Figure 14:
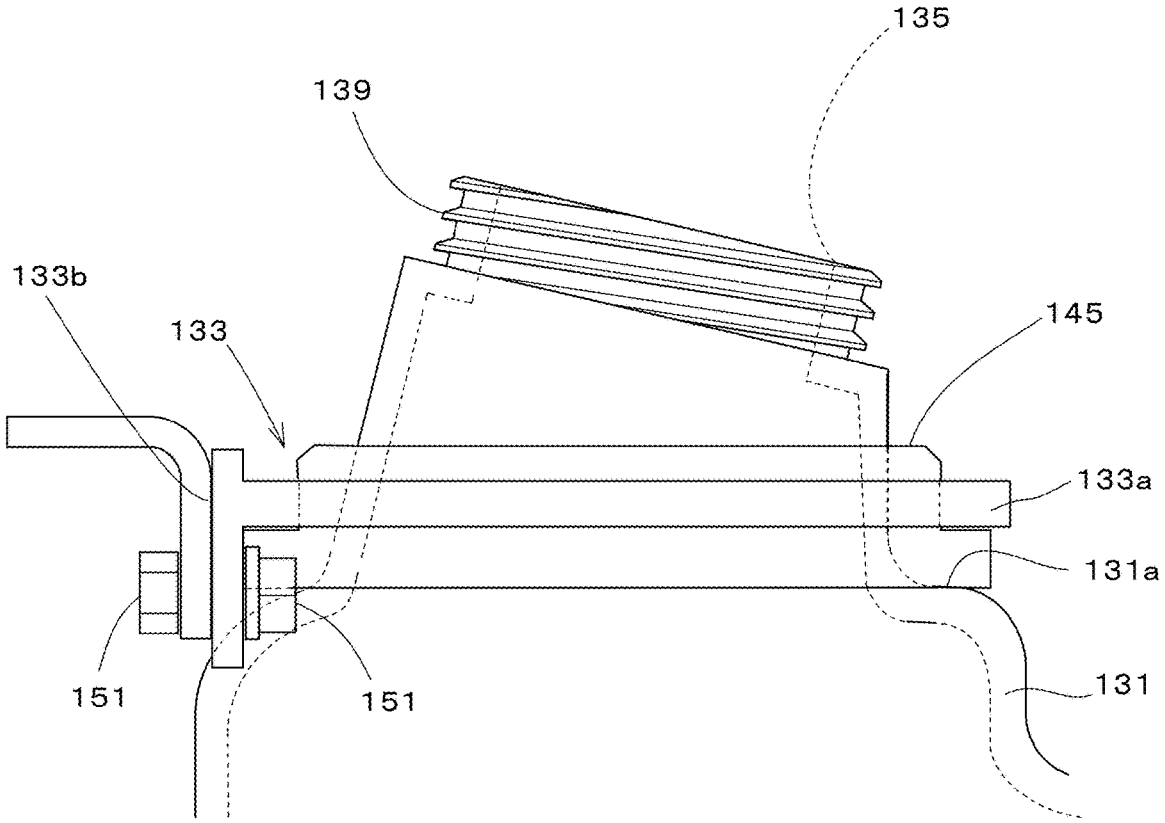
FIG. 14 is an explanatory view of the procedure for attaching the elastic member and the fixing piece to the tubular portion.

As illustrated in FIG. 13, when the elastic member 145 is sandwiched between the first piece 133*a* of the fixing piece 133 and the outer peripheral surface of the tubular portion 132, the fixing tools 151 are inserted into the fixing holes 152 of the second piece 133*b* of the fixing piece 133, and as illustrated in FIG. 14, the fixing piece 133 is fixed to the machine body 2 (in the present embodiment, the upper surface of the hydraulic fluid tank 150 fixed to the machine body 2).

Accordingly, the elastic member 145 and the fixing piece 133 can be assembled while the elastic member 145 and the fixing piece 133 are moved in the direction orthogonal to the outer surface 131*a* of the tank body 131.

The example embodiments of the present invention provide a working machine 1 described in the following items.

(Item 1) A working machine 1 comprising: a machine body 2; a tank 130 including a tank body 131 to store a liquid, and a tubular portion 132 protruding from an outer surface 131*a* of the tank body 131 in a protruding direction inclined with respect to the outer surface 131*a*; a fixing piece 133 having a through hole 149 through which the tubular portion 132 is inserted, to fix the tank 130 to the machine body 2; and an elastic member 145 sandwiched between the fixing piece 133 and the tubular portion 132, wherein the tubular portion 132 has one end connected to the tank body 131 and another end defining a liquid supply opening 135, the elastic member 145 is fitted on the tubular portion 132 in a state of being substantially parallel to the outer surface 131*a* and non-perpendicular to the protruding direction of the tubular portion 132, and the fixing piece 133 is fitted on the elastic member 145 fitted on the tubular portion 132, substantially in parallel to the outer surface 131*a*, and is fixed to the machine body 2.

With the working machine 1 according to Item 1, the elastic member 145 and the fixing piece 133 can be assembled to the tubular portion 132 protruding in the protruding direction inclined from the outer surface 131*a* of the tank body 131, substantially in parallel to the outer surface 131*a* of the tank body 131. Hence the tank 130 including the tubular portion 132 protruding in the direction inclined from the tank body 131 can be easily fixed to the machine body 2.

(Item 2) The working machine 1 according to Item 1, wherein an inner peripheral surface 145*c* of the elastic member 145 has a shape in close contact with an annular contact area 131*a* of an outer peripheral surface of the tubular portion 132, the contact area 132*c* being substantially parallel to the outer surface 131*a* and non-perpendicular to the protruding direction of the tubular portion 132.

With the working machine 1 according to Item 2, the elastic member 145 can be assembled only by being fitted on the tubular portion 132. Also, the tank 130 can be stably fixed by the close contact between the inner peripheral surface 145*c* of the elastic member 145 and the contact area 132*c* included in the outer peripheral surface of the tubular portion 132.

(Item 3) The working machine 1 according to Item 2, wherein the tubular portion 132 is disposed such that a portion of the tubular portion 132 closer to the other end than the contact area 132*c* is accommodated within a range of a closed curve formed by the contact area 132*c* in a projection when viewed in a direction orthogonal to the outer surface 131*a*.

With the working machine 1 according to Item 3, the elastic member 145 can be easily assembled (fitted) to the tubular portion 132 simply by the elastic member 145 being caused to approach (brought close to) the outer surface 131*a* of the tank body 131 straight in the direction orthogonal to the outer surface 131*a*.

(Item 4) The working machine 1 according to any one of Items 1 to 3, wherein the tubular portion 132 has an angle formed between an outer peripheral surface of the tubular portion 132 and the outer surface 131*a* in a section perpendicular to the outer surface 131*a* and passing through a center of the tubular portion 132 at the one end being 90° or more at any position in a circumferential direction of the tubular portion 132.

With the working machine 1 according to Item 4, the elastic member 145 can be caused to approach the outer surface 131*a* of the tank body 131 in the direction orthogonal to the outer surface 131*a*, and the elastic member 145 can be easily assembled to the tubular portion 132.

(Item 5) A working machine 1 comprising: a machine body 2; a tank 130 including a tank body 131 to store a liquid, and a tubular portion 132 protruding from an outer surface 131*a* of the tank body 131 in a protruding direction inclined with respect to the outer surface 131*a*; a fixing piece 133 having a through hole 149 through which the tubular portion 132 is inserted, to fix the tank 130 to the machine body 2; and an elastic member 145 sandwiched between the fixing piece 133 and the tubular portion 132, wherein the tubular portion 132 has one end connected to the tank body 131 and another end defining a liquid supply opening 135, and the tubular portion 132 has an angle formed between an outer peripheral surface of the tubular portion 132 and the outer surface 131*a* in a section perpendicular to the outer surface 131*a* and passing through a center of the tubular portion 132 at the one end being 90° or more at any position in a circumferential direction of the tubular portion 132.

With the working machine 1 according to Item 5, the elastic member 145 can be caused to approach the outer surface 131*a* of the tank body 131 in the direction orthogonal to the outer surface 131*a*, and the elastic member 145 can be easily assembled to the tubular portion 132.

(Item 6) The working machine 1 according to any one of Items 1 to 4, wherein the elastic member 145 has a flange portion 147 sandwiched between the outer surface 131*a* and the fixing piece 133.

With the working machine 1 according to Item 6, the flange portion 147 is disposed between the outer surface 131*a* of the tank body 131 and the fixing piece 133. Hence a state is attained in which the elastic member 145 appropriately presses the tank body 131, and the tank 130 can be reliably fixed.

(Item 7) The working machine 1 according to Item 6, wherein the elastic member 145 has an annular protruding portion 148 extending from the flange portion 147, the annular protruding portion 148 being sandwiched between the tubular portion 132 and an inner peripheral surface of the through hole 149 in the through hole 149.

With the working machine 1 according to Item 7, as described above, the flange portion 147 is disposed between the outer surface 131*a* of the tank body 131 and the fixing piece 133, and also the annular protruding portion 148 is sandwiched between the tubular portion 132 and the inner peripheral surface of the through hole 149. Hence lateral shaking (rattling in the direction orthogonal to the hole center line of the through hole 149) of the tubular portion 132 is restricted.

(Item 8) The working machine 1 according to Item 7, wherein a portion of the annular protruding portion 148 protrudes from the fixing piece 133 toward the other end when the fixing piece 133 is fitted on the annular protruding portion 148.

With the working machine 1 according to Item 8, the portion of the annular protruding portion 148 protruding from the fixing piece 133 is expanded by the elastic force of the elastic member 145, and hence it is possible to prevent or reduce coming off of the elastic member 145 from the through hole 149 of the fixing piece 133.

(Item 9) The working machine 1 according to Item 1, wherein the tank 130 is disposed with the outer surface 131*a* facing upward.

With the working machine 1 according to Item 9, the elastic member 145 and the fixing piece 133 can be easily assembled by being caused to approach the upper surface (outer surface 131*a*) of the tank 130 from above the tank 130.

(Item 10) The working machine 1 according to any one of Items 1 to 9, wherein the tubular portion 132 includes an enlarged portion 136 whose sectional shape is enlarged from a portion near the other end toward the one end, and the elastic member 145 is fitted on the enlarged portion 136.

With the working machine 1 according to Item 10, the elastic member 145 can be easily assembled to the enlarged portion 136 whose sectional shape is enlarged from the portion near the other end toward the one end.

(Item 11) The working machine 1 according to any one of Items 1 to 10, wherein the protruding direction is inclined outward of the machine body 2 with respect to a vertically upward side.

With the working machine 1 according to Item 11, the liquid supply opening 135 is easily accessible from the outside of the working machine 1.

(Item 12) The working machine 1 according to any one of Items 1 to 11, wherein the tank 130 is a fuel tank to store fuel to be supplied to a prime mover 91 provided in the working machine 1.

With the working machine 1 according to Item 12, it is possible to smoothly perform daily refueling work.

While example embodiments of the present invention have been described above, it is to be understood that variations and modifications will be apparent to those skilled in the art without departing from the scope and spirit of the present invention. The scope of the present invention, therefore, is to be determined solely by the following claims.

In the above-described embodiment, the example has been provided in which the tank of the present invention is applied to the fuel tank 130. However, the tank of the present invention may be applied to the hydraulic fluid tank 150 or may be applied to another tank provided in the working machine 1.

In the above-described embodiment, the first portion 132*a* is formed over a half circumference of the tubular portion 132, and the second portion 132*b* is formed over the remaining half circumference of the tubular portion 132. However, this does not imply any limitation. That is, the range in which the first portion 132*a* or the second portion 132*b* is provided is not limited to a half circumference. For example, the first portion 132*a* or the second portion 132*b* may be provided over a range narrower than a half circumference in the circumferential direction. Alternatively, the first portion 132*a* or the second portion 132*b* may be provided over a range wider than a half circumference in the circumferential direction.

In the above-described embodiment, the first portion 132*a* is formed in the substantially truncated semi-conical shape that is enlarged in the direction away from the point O toward the outside as the first portion 132*a* approaches the tank body 131, and the second portion 132*b* is formed in the semi-cylindrical shape around the axis extending in the direction perpendicular to the outer surface 131*a*. However, this does not imply any limitation. For example, each of the first portion 132*a* and the second portion 132*b* may be formed in a substantially truncated semi-conical shape that is enlarged in the direction away from the point O toward the outside as the first portion 132*a* or the second portion 132*b* approaches the tank body 131, and the entire tubular portion 132 (enlarged portion 136) may be formed in a truncated conical shape.

In the above-described embodiment, the tubular portion 132 includes the enlarged portion 136 and the cylindrical portion 137, and the enlarged portion 136 is enlarged toward the tank body 131, so that the tubular portion 132 is enlarged from the portion near the other end toward the one end. However, this does not imply any limitation. For example, when the cap 140 for sealing the liquid supply opening 135 is of a fit-in type, the tubular portion 132 may include only the enlarged portion 136. That is, only the enlarged portion 136 of the above-described embodiment may be the tubular portion 132. In this case, it is needless to say that the distal end opening of the enlarged portion 136 defines the liquid supply opening 135 facing obliquely upward. Also, it is needless to say that the description of the tubular portion 132 in this case can be understood by replacing the enlarged portion 136 in the description of the above-described embodiment with the tubular portion 132.

Although not particularly mentioned in the above-described embodiment, the elastic member 145 (flange portion 147) is not limited to the one being sandwiched between the outer surface (planar portion) 131*a* of the tank body 131 and the fixing piece 133 (first piece 133*a*) over the entire circumference, and the elastic member 145 (flange portion 147) may be partly sandwiched between the outer surface (planar portion) 131*a* of the tank body 131 and the fixing piece 133 (first piece 133*a*). Also, the elastic member 145 is not limited to the one having the annular protruding portion 148. That is, the elastic member 145 may have only a portion corresponding to the flange portion 147 in the above-described embodiment. However, in order to protect the tank 130 from lateral shaking or lateral impact, it is preferable to have the annular protruding portion 148 similarly to the above-described embodiment.

Also, in the present embodiment, the description has been given for the configuration in which the flange portion 147 of the elastic member 145 fitted on the contact area 132*c* of the tubular portion 132 is sandwiched between the outer surface 131*a* of the tank body 131 and the fixing piece 133. However, this does not imply any limitation. For example, a configuration may be provided in which the elastic member 145 fitted on the contact area 132*c* of the tubular portion 132 is sandwiched between the fixing piece 133 and the outer peripheral surface of the tubular portion 132 in a state of being separated from the outer surface 131*a* of the tank body 131. In this case, a configuration may be provided in which the elastic member 145 does not include the flange portion 147.

In the above-described embodiment, the backhoe has been described as the working machine 1. However, this does not imply any limitation. For example, the working machine 1 may be various construction machines other than the backhoe, or may be various agricultural machines such as a tractor and a combine.

What is claimed is:

1. A working machine comprising:

a machine body;

a tank including a tank body to store a liquid, and a tubular portion protruding from an outer surface of the tank body in a protruding direction inclined with respect to the outer surface;

a fixing piece having a through hole through which the tubular portion is inserted, to fix the tank to the machine body; and an elastic member sandwiched between the fixing piece and the tubular portion, wherein the tubular portion has one end connected to the tank body and another end defining a liquid supply opening, the elastic member is fitted on the tubular portion in a state of being substantially parallel to the outer surface and non-perpendicular to the protruding direction of the tubular portion, and the fixing piece is fitted on the elastic member fitted on the tubular portion, substantially in parallel to the outer surface, and is fixed to the machine body.

2. The working machine according to claim 1, wherein an inner peripheral surface of the elastic member has a shape in close contact with an annular contact area of an outer peripheral surface of the tubular portion, the contact area being substantially parallel to the outer surface and non-perpendicular to the protruding direction of the tubular portion.

3. The working machine according to claim 2, wherein the tubular portion is disposed such that a portion of the tubular portion closer to the other end than the contact area is accommodated within a range of a closed curve formed by the contact area in a projection when viewed in a direction orthogonal to the outer surface.

4. The working machine according to claim 1, wherein the tubular portion has an angle formed between an outer peripheral surface of the tubular portion and the outer surface in a section perpendicular to the outer surface and passing through a center of the tubular portion at the one end being 90° or more at any position in a circumferential direction of the tubular portion.

5. The working machine according to claim 1, wherein the elastic member has a flange portion sandwiched between the outer surface and the fixing piece.

6. The working machine according to claim 5, wherein the elastic member has an annular protruding portion extending from the flange portion, the annular protruding portion being sandwiched between the tubular portion and an inner peripheral surface of the through hole in the through hole.

7. The working machine according to claim 6, wherein a portion of the annular protruding portion protrudes from the fixing piece toward the other end when the fixing piece is fitted on the annular protruding portion.

8. The working machine according to claim 1, wherein the tank is disposed with the outer surface facing upward.

9. The working machine according to claim 1, wherein the tubular portion includes an enlarged portion whose sectional shape is enlarged from a portion near the other end toward the one end, and the elastic member is fitted on the enlarged portion.

10. The working machine according to claim 1, wherein the protruding direction is inclined outward of the machine body with respect to a vertically upward side.

11. The working machine according to claim 1, wherein the tank is a fuel tank to store fuel to be supplied to a prime mover provided in the working machine.

12. A working machine comprising:

a machine body;

a tank including: a tank body to store a liquid; and a tubular portion including (i) an inclined portion protruding from an outer surface, which is an upper surface of the tank body, in a protruding direction inclined with respect to a vertically upward direction, and (ii) a non-inclined portion protruding in the vertically upward direction from the outer surface;

a fixing piece having a through hole through which the tubular portion is inserted, to fix the tank to the machine body; and an elastic member sandwiched between the fixing piece and the tubular portion, wherein the tubular portion has one end connected to the tank body and another end defining a liquid supply opening, and the tubular portion is configured such that an angle formed between an outer peripheral surface of the inclined portion and the outer surface outside the tank is more than 90°, and an angle formed between an outer peripheral surface of the non-inclined portion and the outer surface outside the tank is 90°.

* * * * *